US009394707B2

(12) United States Patent
Yi et al.

(10) Patent No.: US 9,394,707 B2
(45) Date of Patent: Jul. 19, 2016

(54) BOOM APPARATUS AND CONCRETE PUMP VEHICLE HAVING SAME

(71) Applicants: HUNAN SANY INTELLIGENT CONTROL EQUIPMENT CO., LTD, Changsha, Hunan (CN); SANY HEAVY INDUSTRY CO., LTD, Changsha, Hunan (CN)

(72) Inventors: Xiaogang Yi, Hunan (CN); Shihui Xie, Hunan (CN); Haibo Tan, Hunan (CN)

(73) Assignees: HUNAN SANY INTELLIGENT CONTROL EQUIPMENT CO., LTD, Changsha, Hunan (CN); SANY HEAVY INDUSTRY CO., LTD, Changsha, Hunan (CN)

( * ) Notice: Subject to any disclaimer, the term of this patent is extended or adjusted under 35 U.S.C. 154(b) by 122 days.

(21) Appl. No.: 14/183,910

(22) Filed: Feb. 19, 2014

(65) Prior Publication Data

US 2014/0175254 A1 Jun. 26, 2014

Related U.S. Application Data

(63) Continuation of application No. PCT/CN2012/074113, filed on Apr. 16, 2012.

(30) Foreign Application Priority Data

Aug. 19, 2011 (CN) ..... 2011 1 0240476

(51) Int. Cl.
*E03B 1/00* (2006.01)
*E04G 21/04* (2006.01)
*B66C 23/00* (2006.01)

(52) U.S. Cl.
CPC ..... *E04G 21/0445* (2013.01); *B66C 23/54* (2013.01); *E04G 21/0436* (2013.01)

(58) Field of Classification Search
CPC . E04G 21/04; E04G 21/0436; E04G 21/0445; B67D 9/02; F16L 27/0861; B66C 23/64; B66C 23/42; B66C 23/60; B66C 23/68; B66C 23/54
USPC ..... 137/615, 351; 248/637, 558
See application file for complete search history.

(56) References Cited

U.S. PATENT DOCUMENTS 4,828,033 A * 5/1989 Frison ..... B67D 7/002 137/615
6,220,292 B1 4/2001 Woodling et al.
(Continued)

FOREIGN PATENT DOCUMENTS

CN 201738589 U 2/2011
CN 201756806 U 3/2011
(Continued)

OTHER PUBLICATIONS

State Intellectual Property Office of P. R. China (ISR/CN), "International Search Report", Jul. 19, 2012, China.

*Primary Examiner* — Todd M Epps
(74) *Attorney, Agent, or Firm* — Tim Tingkang Xia, Esq.; Locke Lord LLP

(57) ABSTRACT

In one aspect of the invention, a boom apparatus used for a concrete pump vehicle includes multiple booms, where the multiple booms comprise a first boom hinge-connected to a turntable of the concrete pump vehicle and a second boom hinge-connected to the first boom. When the boom apparatus is in a folded state, the first boom extends towards a cab of the concrete pump vehicle, and the second boom is further placed above the first boom. The invention also provides a concrete pump vehicle having the boom apparatus.

17 Claims, 2 Drawing Sheets

(56) References Cited

U.S. PATENT DOCUMENTS

| | | | | |
|---|---|---|---|---|
| 6,871,667 | B2 * | 3/2005 | Schwing | E04G 21/04 137/615 |
| 7,543,851 | B2 * | 6/2009 | Wolfram | B66C 23/42 212/181 |
| 2011/0220228 | A1 * | 9/2011 | Maini | B66C 23/64 137/615 |

FOREIGN PATENT DOCUMENTS

| | | | |
|---|---|---|---|
| CN | 102383603 | A | 3/2012 |
| EP | 0037571 | A2 | 10/1981 |
| EP | 1970344 | A1 | 9/2008 |

* cited by examiner

BOOM APPARATUS AND CONCRETE PUMP VEHICLE HAVING SAME

CROSS-REFERENCE TO RELATED APPLICATIONS

This application is a continuation application of International Patent Application No. PCT/CN2012/074113, filed Apr. 16, 2012, entitled "CONCRETE PUMP TRUCK AND ARM STAND DEVICE THEREOF", by Xiaogang Yi et al., which itself claims the priority to Chinese Patent Application No. 201110240476.9, filed Aug. 19, 2011, entitled "BOOM APPARATUS AND CONCRETE PUMP VEHICLE HAVING SAME", by Xiaogang Yi et al., the disclosures for which are hereby incorporated herein in their entireties by reference.

FIELD OF THE INVENTION

The invention relates to the field of construction machinery, and more particularly to a boom apparatus and a concrete pump vehicle having the boom apparatus.

BACKGROUND OF THE INVENTION

A concrete pump vehicle is common construction machinery and is used to deliver concrete slurry to a predetermined location through a delivery pipeline, so as to perform a concrete pouring operation in a location away from a mixing station. As the real estate and infrastructure construction develops rapidly, demands on the concrete pump vehicles increase constantly.

PCT Publication No. WO 2006/097827A2, discloses a concrete pump vehicle, where a boom apparatus of the concrete pump vehicle includes a first boom, a second boom, a third boom, a fourth boom, a fifth boom, a sixth boom, and a seventh boom. The first boom is hinge-connected to a turntable of the concrete pump vehicle, as shown in FIG. 1. When in the folded state, the seven booms are all located on a side, close to the rear of the concrete pump vehicle, of the turntable, and the second boom and the third boom are both located below the first boom. However, the concrete pump vehicle disclosed in the PCT Publication has the following defects.

Firstly, the first boom and the second boom cannot be unfolded simultaneously. The first boom needs to be unfolded first, and then the second boom is unfolded. Otherwise, the second boom hits a boarding platform of the concrete pump vehicle. Therefore, it takes the boom apparatus more time to unfold completely, thereby affecting working efficiency of the concrete pump vehicle.

Secondly, the seven booms are all disposed backwards, and located on the side, close to the rear of the vehicle, of the turntable, so that the space from one side, close to the cab, of the turntable to the position above the cab is not utilized, and a maximum length of the unfolded boom apparatus is also limited.

Thirdly, the seven booms are all disposed backwards, and located on the side, close to the rear of the vehicle, of the turntable, so that the position of the center of gravity of the vehicle is close to the rear, the position of the center of gravity is not reasonable, and axle loading capacity of the front axle of the concrete pump vehicle is not fully taken advantage thereof.

Additionally, the last two booms, namely the sixth boom and the seventh boom, cannot be very long; otherwise, when the first boom is unfolded, the last two booms hit the boarding platform of the concrete pump vehicle.

Therefore, a heretofore unaddressed need exists in the art to address the aforementioned deficiencies and inadequacies.

SUMMARY OF THE INVENTION

One of the objectives is to provide a boom apparatus, so as to solve the foregoing technical problems of the prior art. According to a structural design of the boom apparatus of the invention, a first boom and a second boom are enabled to be unfolded simultaneously, so as to reduce time required to unfold the boom apparatus. Further, the center of gravity of the vehicle is enabled to move forwards, so as to fully take advantage of axle loading capacity of the front axle. Furthermore, the last two booms of the boom apparatus can be extended, so as to increase a maximum length of the boom apparatus. Additionally, the invention also provides a concrete pump vehicle including the boom apparatus.

In one aspect of the invention, a boom apparatus used for a concrete pump vehicle includes multiple booms, where the multiple booms include a first boom hinge-connected to a turntable of the concrete pump vehicle and a second boom hinge-connected to the first boom; when in the folded state, the first boom extends towards a cab of the concrete pump vehicle, and the second boom is further placed above the first boom.

In one embodiment, the first boom further extends to a position over the cab.

In one embodiment, the second boom extends from a tail end of the first boom to the rear of the concrete pump vehicle or further exceeds the rear.

In one embodiment, the multiple booms further include a third boom hinge-connected to a tail end of the second boom, and when in the folded state, the third boom is disposed on a side, close to the rear of the concrete pump vehicle, of the turntable, and is disposed below the second boom.

In one embodiment, the multiple booms further include a fourth boom hinge-connected to a tail end of the third boom, and when in the folded state, the fourth boom is disposed between the second boom and the third boom, and a tail end of the fourth boom is biasedly placed at the second boom.

In one embodiment, the multiple booms further include a fifth boom hinge-connected to the tail end of the fourth boom, and when in the folded state, the fifth boom and the tail end of the fourth boom are on a same side of the second boom, and a tail end of the fifth boom further extends to a position above the cab.

In one embodiment, the multiple booms further include a sixth boom hinge-connected to the tail end of the fifth boom, and when in the folded state, a tail end of the sixth boom further extends to the rear or beyond the rear.

In one embodiment, the turntable is further provided with a hinge-connecting plate, the first boom is hinge-connected to the hinge-connecting plate, and a derricking cylinder is further hinge-connected between the first boom and the hinge-connecting plate.

In one embodiment, the hinge-connecting plate is provided with an upper hinging point close to the rear and a lower hinging point close to the cab, the first boom is hinge-connected to the lower hinging point, and the derricking cylinder has one end hinge-connected to the first boom and has the other end hinge-connected to the upper hinging point.

In one embodiment, the hinge-connecting plate includes a primary hinge-connecting plate and a secondary hinge-connecting plate. The first boom is hinge-connected to the primary hinge-connecting plate, a lower end of the first boom is hinge-connected to the secondary hinge-connecting plate, the derricking cylinder has one end hinge-connected to the first boom and the other end hinge-connected to the secondary hinge-connecting plate, and a connecting rod is further hinge-connected between the secondary hinge-connecting plate and the primary hinge-connecting plate, so that the first boom is capable of rotating by 180°.

In one embodiment, the derricking cylinder has one end hinge-connected to a hinging point on a side, close to the cab, of the hinge-connecting plate, and the other end hinge-connected to the first boom, and a limiting lever, which bears a pulling force from the first boom when the first boom is vertically disposed, is further hinge-connected between the side, close to the cab, of the hinge-connecting plate and the first boom.

In another aspect of the invention, a concrete pump vehicle includes a turntable and the boom apparatus according to any one of the above embodiments, where the first boom is hinge-connected to the turntable.

Compared with the prior art, when the boom apparatus provided by the invention is in the folded state, the first boom is disposed on a side, close to the cab of the concrete pump vehicle, of the turntable, and the second boom is further hinge-connected above the first boom, so that the first boom and the second boom can be unfolded simultaneously, which avoids the problem of extended time incurred by non-simultaneous unfolding of the two, so as to reduce time required for unfolding the boom apparatus, thereby ensuring working efficiency of the concrete pump vehicle.

Additionally, the second boom and the first boom can be unfolded simultaneously, and as unfolding continues, the second boom is increasingly farther away from a boarding platform, so that last two booms, which move along with the second boom, can be made longer without worrying about the problem that when the first boom and the second boom are unfolded, the last two booms hit the boarding platform, thereby increasing the maximum length of the unfolded boom apparatus.

Further, the first boom is disposed on the side, close to the cab of the concrete pump vehicle, of the turntable, and the second boom and the last two boom are also partially disposed on the side, close to the cab of the concrete pump vehicle, of the turntable, so that the center of gravity of the vehicle can be moved forwards, so as to fully take advantage of axle loading capacity of the front axle of the concrete pump vehicle, thereby making the position of the center of gravity reasonable.

These and other aspects of the invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
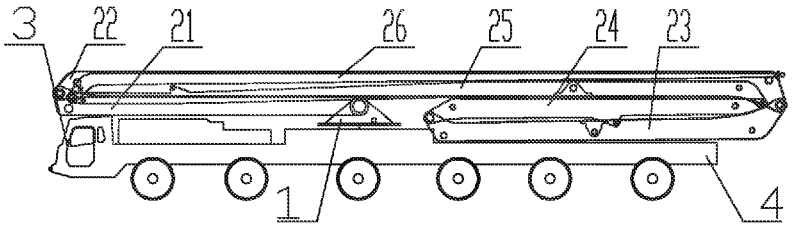
FIG. 1 is a schematic structural view showing that a boom apparatus is in the folded state according to an embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-5. In accordance with the purposes of this invention, as embodied and broadly described herein, this invention, in one aspect, relates to a boom apparatus and a concrete pump vehicle having the boom apparatus.

A core of the invention is to provide a boom apparatus. According to the structural design of the boom apparatus, a first boom and a second boom are enabled to be unfolded simultaneously, so as to reduce time required to unfold the boom apparatus. Further, the center of gravity of the vehicle is enabled to move forwards, so as to fully take advantage of axle loading capacity of the front axle. Furthermore, the last two booms of the boom apparatus can be extended, so as to increase a maximum length of the boom apparatus. Additionally, another core of the invention is to provide a concrete pump vehicle including the boom apparatus.

Figure 2:
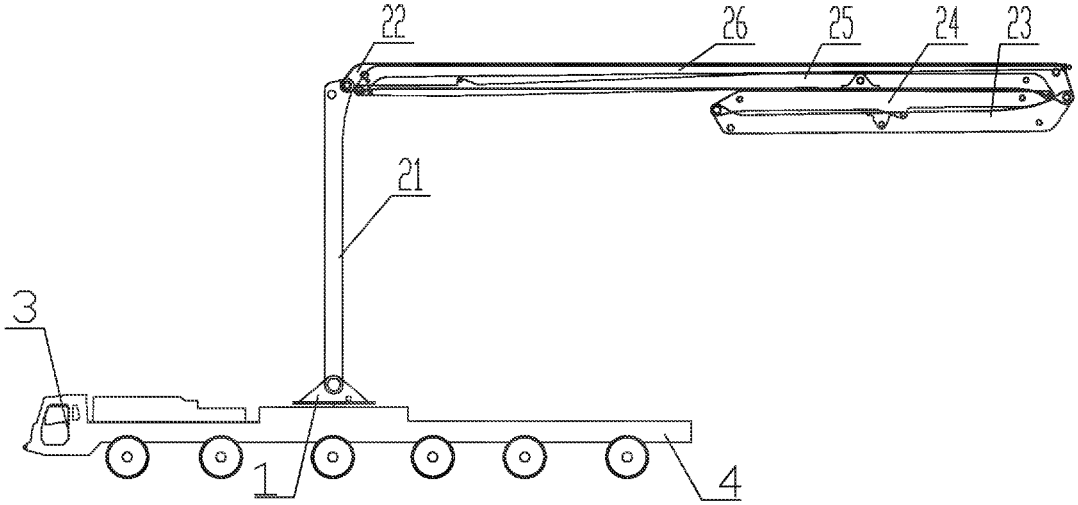
FIG. 2 is a schematic structural view showing that a first boom and a second boom of the boom apparatus in FIG. 1 are unfolded.

Referring to FIGS. 1 and 2, FIG. 1 is a schematic structural view showing that a boom apparatus is in the folded state according to an embodiment of the invention, and FIG. 2 is a schematic structural view showing that a first boom and a second boom of the boom apparatus shown in FIG. 1 are unfolded.

In the embodiment, a boom apparatus used for a concrete pump vehicle includes multiple booms. The multiple booms include a first boom 21 hinge-connected to a turntable 1 of the concrete pump vehicle and a second boom 22 hinge-connected to the first boom 21. Based on this arrangement, as shown in FIG. 1, when the boom apparatus is in the folded state, the first boom 21 extends towards a cab 3 of the concrete pump vehicle, and the second boom 22 is further placed above the first boom 21. It should be noted that, "the second boom 22 is further placed above the first boom 21" specifically refers to, but not limited to, that the second boom 22 not only can be placed right over the first boom 21, but also can be placed laterally above the first boom 21.

It should be noted that the invention does not limit the number of the booms. All the designs, where there are four booms, five booms, six booms, or more booms, shall fall within the protection scope of the invention as long as the aforementioned structural design of the first boom 21 and the second boom 22 is adopted.

According to the invention, when the boom apparatus is in the folded state, the first boom 21 is disposed on a side, close to the cab 3 of the concrete pump vehicle, of the turntable 1, and the second boom 22 is further placed above the first boom 21, so that the first boom 21 and the second boom 22 can be unfolded simultaneously, which avoids the problem of extended time incurred by non-simultaneous unfolding of the two, so as to reduce time required for unfolding the boom apparatus, thereby ensuring working efficiency of the concrete pump vehicle.

Additionally, the second boom 22 and the first boom 21 can be unfolded simultaneously, and as unfolding continues, the second boom 22 is increasingly farther away from a boarding platform, so that last two booms, which move along with the second boom 22, can be made longer without worrying about the problem that when the first boom 21 and the second boom 22 are unfolded, the last two booms hit the boarding platform, thereby increasing the maximum length of the unfolded boom apparatus.

Further, the first boom 21 is disposed on the side, close to the cab 3 of the concrete pump vehicle, of the turntable 1, and the second boom 22 and the last two boom are also partially disposed on the side, close to the cab 3 of the concrete pump vehicle, of the turntable 1, so that the center of gravity of the vehicle can be moved forwards, so as to fully take advantage of axle loading capacity of the front axle of the concrete pump vehicle, thereby making the position of the center of gravity reasonable.

Specifically, as shown in FIG. 1, the first boom 21 further extends to a position above the cab 3; no doubt that a specific meaning of the structure also includes that a tail end of the first boom 21 extends above the cab 3 and beyond the cab 3. The structural design makes the boom apparatus fully take advantage of a space above the cab 3, so as to maximally increase the maximum length of the unfolded boom apparatus.

Further, in order to further increase the maximum length of the unfolded boom apparatus, as shown in FIG. 1, a tail end, away from the first boom 21, of the second boom 22 may extend to the rear 4 of the concrete pump vehicle or even beyond the rear 4.

It should be noted that in any one of the aforementioned technical solutions, a specific design may further be made. For example, as shown in FIG. 1, the multiple booms further include a third boom 23 hinge-connected to the tail end of the second boom 22, and when in the folded state, the third boom 23 is disposed on a side, close to the rear 4 of the concrete pump vehicle, of the turntable 1, and is disposed below the second boom 22. The structural design can fully take advantage of a space that is on the side, close to the rear 4 of the concrete pump vehicle, of the turntable 1 and is below the second boom 22.

Further, as shown in FIGS. 1 and 2, the multiple booms also include a fourth boom 24 hinge-connected to a tail end of the third boom 23, and when in the folded state, the fourth boom 24 is disposed between the second boom 22 and the third boom 23, and a tail end of the fourth boom 24 is biasedly placed at the second boom 22. The structural design makes the fourth boom 24 fully take advantage of a space in a gap between the second boom 22 and the third boom 23, so as to make the structure more compact; further, the tail end of the fourth boom 24 extends out of the gap to one side, so as to create a condition for connecting a fifth boom 25.

In addition, as shown in FIGS. 1 and 2, the multiple booms further include the fifth boom 25 hinge-connected to the tail end of the fourth boom 24, and when in the folded state, the fifth boom 25 and the tail end of the fourth boom 24 are on a same side of the second boom 22, and a tail end of the fifth boom 25 further extends to a position above the cab 3. The fifth boom 25 is disposed on one side of the second boom 22, and is located higher than the turntable 1, so that the fifth boom 25 can extend to the position above the cab 3, so as to further increase the maximum length of the unfolded boom apparatus.

Moreover, as shown in FIG. 1, the multiple booms also include a sixth boom 26 hinge-connected to the tail end of the fifth boom 25, and when in the folded state, the sixth boom 26 can be disposed above the fifth boom 25, and a tail end of the sixth boom 26 further extends to the rear 4 or beyond the rear 4. Obviously, the structural design can further increase the maximum length of the unfolded boom apparatus.

It should be noted that the tail end of the sixth boom 26 may further be hinge-connected to a seventh boom, and when in the folded state, a tail end of the seventh boom can extend to a position above the cab 3. Further, the tail end of the seventh boom may further be hinge-connected to an eighth boom, and when in the folded state, a tail end of the eighth boom can extend to the rear 4 or beyond the rear 4. Without any limitations of the scope of the invention, in one embodiment, a ninth boom or more booms may further be hinge-connected behind the eighth boom.

Figure 3:
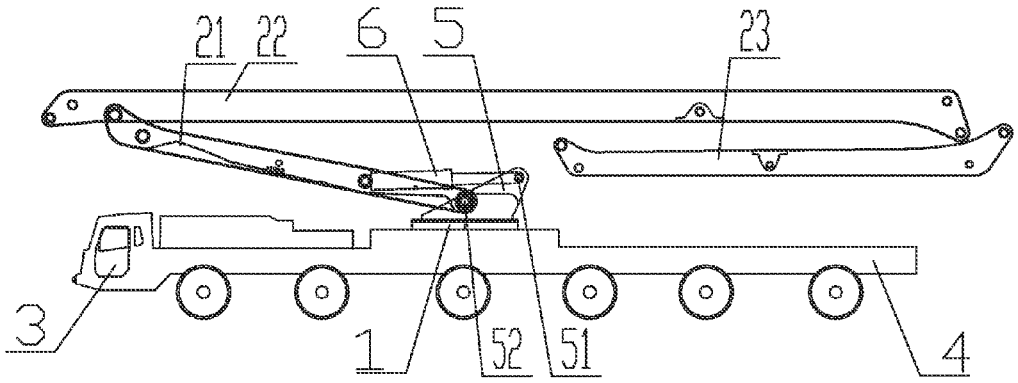
FIG. 3 is a schematic structural diagram showing installation of a derricking cylinder of a boom apparatus according to a first embodiment of the invention.
Figure 4:
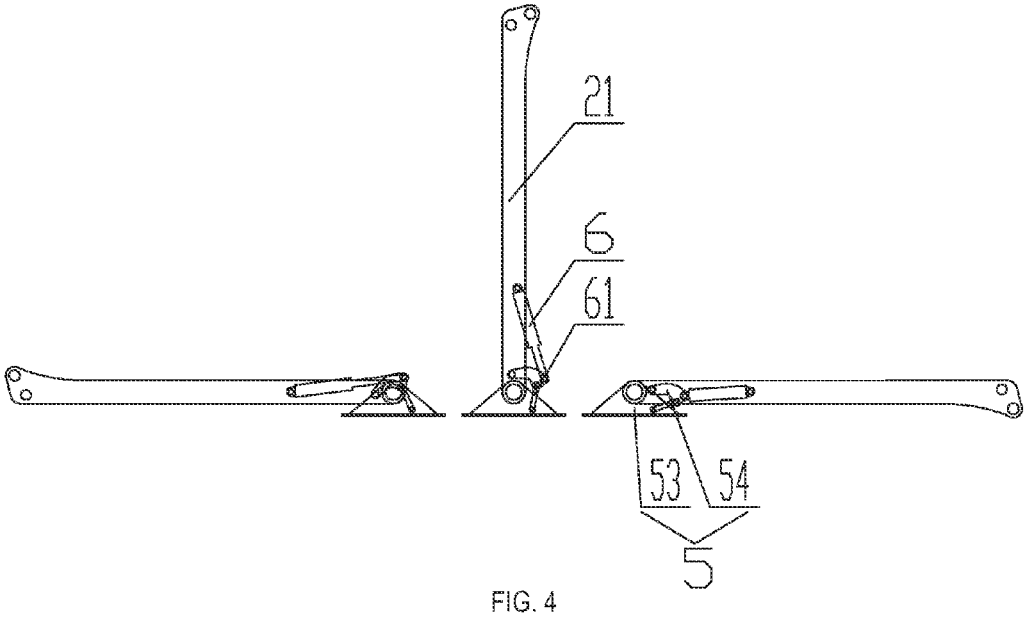
FIG. 4 is a schematic structural diagram showing installation of a derricking cylinder of a boom apparatus according to a second embodiment of the invention.
Figure 5:
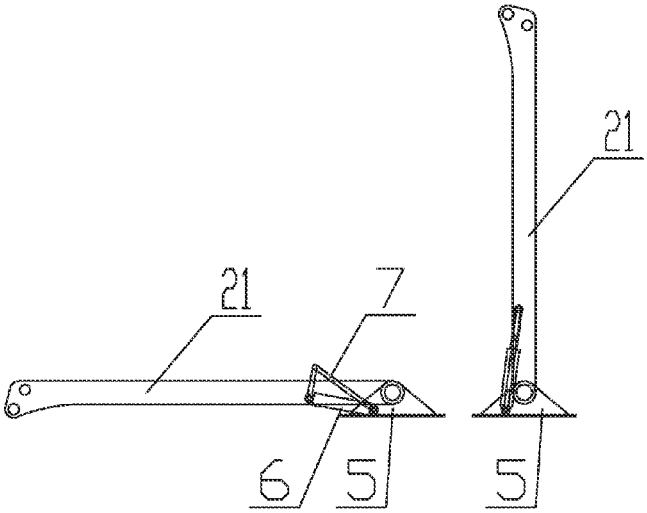
FIG. 5 is a schematic structural diagram showing installation of a derricking cylinder of a boom apparatus according to a third embodiment of the invention.

Based on any one of the aforementioned technical solutions, further embodiments of the boom apparatus designs are shown in FIGS. 3-5. FIG. 3 is a schematic structural diagram showing installation of a derricking cylinder of a boom apparatus according to a first embodiment of the invention; FIG. 4 is a schematic structural diagram showing installation of a derricking cylinder of a boom apparatus according to a second embodiment of the invention; and FIG. 5 is a schematic structural diagram showing installation of a derricking cylinder of a boom apparatus according to a third embodiment of the invention.

As shown in FIGS. 3-5, the turntable 1 is further provided with a hinge-connecting plate 5. The first boom 21 is hinge-connected to the hinge-connecting plate 5. A derricking cylinder 6 is further hinge-connected between the first boom 21 and the hinge-connecting plate 5. The structural design can realize unfolding and folding of the first boom 21.

According to the aforementioned structure of the invention, improvements are further made. For example, as shown in FIG. 3, the hinge-connecting plate 5 is provided with an upper hinging point 51 close to the rear 4 and a lower hinging point 52 close to the cab 3. It should be noted that the upper hinging point 51 is vertically higher than the lower hinging point 52; the first boom 21 is hinge-connected to the lower hinging point 52, and the derricking cylinder 6 has one end hinge-connected to the first boom 21 and has the other end hinge-connected to the upper hinging point 51. As shown in FIG. 1, as the derricking cylinder 6 extends, the first boom 21 is folded horizontally, and as the derricking cylinder 6 retracts, the first boom 21 is vertically unfolded; and when the first boom 21 is vertically unfolded, the derricking cylinder 6 bears a pressing force from the first boom 21, and therefore can steadily support the first boom 21.

As shown in FIG. 4, the hinge-connecting plate 5 includes a primary hinge-connecting plate 53 and a secondary hinge-connecting plate 54, the first boom 21 is hinge-connected to the primary hinge-connecting plate 53, a lower end of the first boom 21 is hinge-connected to the secondary hinge-connecting plate 54, the derricking cylinder 6 has one end hinge-connected to the first boom 21 and the other end hinge-connected to the secondary hinge-connecting plate 54. A connecting rod 61 is further hinge-connected between the secondary hinge-connecting plate 54 and the primary hinge-connecting plate 53. Specifically, as shown in FIG. 4, the secondary hinge-connecting plate 54 is specifically a curved triangular plate, a hinging point of an angle end of the curved triangular plate is hinge-connected to the first boom 21, and hinging points of the other two angles of the curved triangular plate are hinge-connected to the connecting rod 61 and the derricking cylinder 6 respectively. As shown in FIG. 4, the structural design can enable the first boom 21 to rotate by 180°, so as to increase a horizontal extension length of the boom.

Further, another installation structure of the derricking cylinder 6 is specifically shown in FIG. 5, where the derricking cylinder 6 has one end hinge-connected to the hinging point on the side, close to the cab 3, of the hinge-connecting plate 5, and the other end hinge-connected to the first boom 21, and a limiting lever 7, which bears a pulling force from the first boom 21 when the first boom 21 is vertically disposed, is further hinge-connected between the side, close to the cab 3, of the hinge-connecting plate 5 and the first boom 21. The limiting lever 7 includes two lever members, and the two are hinge-connected to each other. As shown in FIG. 5, when the first boom 21 is folded, the limiting lever 7 bends, and when the first boom 21 vertically unfolded, the limiting lever 7 is pulled straight, so as to bear the pulling force from the first boom 21 to pull the first boom 21. The structural design can prevent the derricking cylinder 6 from bearing the pulling force from the first boom 21, so as to prevent the derricking cylinder 6 from being damaged.

In addition, the invention also provides a concrete pump vehicle includes a turntable 1, and the boom apparatus according to any one of the aforementioned embodiments. As shown in FIG. 1, a first boom 21 is hinge-connected to the turntable 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A boom apparatus used for a concrete pump vehicle, comprising:

multiple booms, wherein the multiple booms comprise a first boom hinge-connected to a turntable of the concrete pump vehicle and a second boom hinge-connected to the first boom, and when in a folded state, the first boom extends towards a cab of the concrete pump vehicle, and the second boom is further placed above the first boom;

wherein the multiple booms further comprise a third boom hinge-connected to a tail end of the second boom, and when in the folded state, the third boom is disposed on a side, close to a rear of the concrete pump vehicle, of the turntable, and is disposed below the second boom;

wherein the multiple booms further comprise a fourth boom hinge-connected to a tail end of the third boom, and when in the folded state, the fourth boom is disposed between the second boom and the third boom, and a tail end of the fourth boom is biasedly placed at the second boom;

wherein the multiple booms further comprise a fifth boom hinge-connected to the tail end of the fourth boom, and when in the folded state, the fifth boom and the tail end of the fourth boom are on a same side of the second boom, and a tail end of the fifth boom further extends to a position above the cab of the concrete pump vehicle;

wherein the multiple booms further comprise a sixth boom hinge-connected to the tail end of the fifth boom, and when in the folded state, a tail end of the sixth boom further extends to the rear of the concrete pump vehicle or beyond the rear of the concrete pump vehicle.

2. The boom apparatus according to claim 1, wherein the first boom further extends to a position over the cab of the concrete pump vehicle.

3. The boom apparatus according to claim 1, wherein the second boom extends from a tail end of the first boom to the rear of the concrete pump vehicle or further exceeds the rear of the concrete pump vehicle.

4. The boom apparatus according to claim 1, wherein the turntable is provided with a hinge-connecting plate, the first boom is hinge-connected to the hinge-connecting plate, and a derricking cylinder is further hinge-connected between the first boom and the hinge-connecting plate.

5. The boom apparatus according to claim 4, wherein the hinge-connecting plate is provided with an upper hinging point close to the rear of the concrete pump vehicle and a lower hinging point close to the cab of the concrete pump vehicle, the first boom is hinge-connected to the lower hinging point, and the derricking cylinder has one end hinge-connected to the first boom and has the other end hinge-connected to the upper hinging point.

6. The boom apparatus according to claim 5, wherein the hinge-connecting plate comprises a primary hinge-connecting plate and a secondary hinge-connecting plate, wherein the first boom is hinge-connected to the primary hinge-connecting plate, a lower end of the first boom is hinge-connected to the secondary hinge-connecting plate, the derricking cylinder has one end hinge-connected to the first boom and the other end hinge-connected to the secondary hinge-connecting plate, and a connecting rod is further hinge-connected between the secondary hinge-connecting plate and the primary hinge-connecting plate, so that the first boom is capable of rotating by 180°.

7. The boom apparatus according to claim 4, wherein the derricking cylinder has one end hinge-connected to a hinging point on a side, close to the cab of the concrete pump vehicle, of the hinge-connecting plate, and the other end hinge-connected to the first boom, and wherein a limiting lever that bears a pulling force from the first boom when the first boom is vertically disposed is further hinge-connected between the side, close to the cab of the concrete pump vehicle, of the hinge-connecting plate and the first boom.

8. A concrete pump vehicle, comprising:

a turntable; and a boom apparatus comprising multiple booms, wherein the multiple booms comprise a first boom hinge-connected to the turntable and a second boom hinge-connected to the first boom, and when in a folded state, the first boom extends towards a cab of the concrete pump vehicle, and the second boom is further placed above the first boom, wherein the turntable is provided with a hinge-connecting plate, the first boom is hinge-connected to the hinge-connecting plate, and a derricking cylinder is further hinge-connected between the first boom and the hinge-connecting plate; and wherein the hinge-connecting plate is provided with an upper hinging point close to a rear of the concrete pump vehicle and a lower hinging point close to the cab of the concrete pump vehicle, the first boom is hinge-connected to the lower hinging point, and the derricking cylinder has one end hinge-connected to the first boom and has the other end hinge-connected to the upper hinging point.

9. The concrete pump vehicle according to claim 8, wherein the multiple booms further comprise a third boom hinge-connected to a tail end of the second boom, and when in the folded state, the third boom is disposed on a side, close to the rear of the concrete pump vehicle, of the turntable, and is disposed below the second boom.

10. The concrete pump vehicle according to claim 9, wherein the multiple booms further comprise a fourth boom hinge-connected to a tail end of the third boom, and when in the folded state, the fourth boom is disposed between the second boom and the third boom, and a tail end of the fourth boom is biasedly placed at the second boom.

11. The concrete pump vehicle according to claim 10, wherein the multiple booms further comprise a fifth boom hinge-connected to the tail end of the fourth boom, and when in the folded state, the fifth boom and the tail end of the fourth boom are on a same side of the second boom, and a tail end of the fifth boom further extends to a position above the cab of the concrete pump vehicle.

12. The concrete pump vehicle according to claim 11, wherein the multiple booms further comprise a sixth boom hinge-connected to the tail end of the fifth boom, and when in the folded state, a tail end of the sixth boom further extends to the rear of the concrete pump vehicle or beyond the rear of the concrete pump vehicle.

13. A concrete pump vehicle, comprising:

a turntable; and a boom apparatus comprising multiple booms, wherein the multiple booms comprise a first boom hinge-connected to the turntable and a second boom hinge-connected to the first boom, and when in a folded state, the first boom extends towards a cab of the concrete pump vehicle, and the second boom is further placed above the first boom;

wherein the multiple booms further comprise a third boom hinge-connected to a tail end of the second boom, and when in the folded state, the third boom is disposed on a side, close to the rear of the concrete pump vehicle, of the turntable, and is disposed below the second boom;

wherein the multiple booms further comprise a fourth boom hinge-connected to a tail end of the third boom, and when in the folded state, the fourth boom is disposed between the second boom and the third boom, and a tail end of the fourth boom is biasedly placed at the second boom;

wherein the multiple booms further comprise a fifth boom hinge-connected to the tail end of the fourth boom, and when in the folded state, the fifth boom and the tail end of the fourth boom are on a same side of the second boom, and a tail end of the fifth boom further extends to a position above the cab of the concrete pump vehicle; and wherein the multiple booms further comprise a sixth boom hinge-connected to the tail end of the fifth boom, and when in the folded state, a tail end of the sixth boom further extends to the rear or beyond the rear of the concrete pump vehicle.

14. The concrete pump vehicle according to claim 13, wherein the turntable is provided with a hinge-connecting plate, the first boom is hinge-connected to the hinge-connecting plate, and a derricking cylinder is further hinge-connected between the first boom and the hinge-connecting plate.

15. The concrete pump vehicle according to claim 14, wherein the hinge-connecting plate is provided with an upper hinging point close to the rear of the concrete pump vehicle and a lower hinging point close to the cab of the concrete pump vehicle, the first boom is hinge-connected to the lower hinging point, and the derricking cylinder has one end hinge-connected to the first boom and has the other end hinge-connected to the upper hinging point.

16. The concrete pump vehicle according to claim 14, wherein the hinge-connecting plate comprises a primary hinge-connecting plate and a secondary hinge-connecting plate, wherein the first boom is hinge-connected to the primary hinge-connecting plate, a lower end of the first boom is hinge-connected to the secondary hinge-connecting plate, the derricking cylinder has one end hinge-connected to the first boom and the other end hinge-connected to the secondary hinge-connecting plate, and a connecting rod is further hinge-connected between the secondary hinge-connecting plate and the primary hinge-connecting plate, so that the first boom is capable of rotating by 180°.

17. The concrete pump vehicle according to claim 14, wherein the derricking cylinder has one end hinge-connected to a hinging point on a side, close to the cab of the concrete pump vehicle, of the hinge-connecting plate, and the other end hinge-connected to the first boom, and wherein a limiting lever that bears a pulling force from the first boom when the first boom is vertically disposed is further hinge-connected between the side, close to the cab of the concrete pump vehicle, of the hinge-connecting plate and the first boom.

* * * * *